US009216338B1

(12) United States Patent
Lee et al.

(10) Patent No.: US 9,216,338 B1
(45) Date of Patent: Dec. 22, 2015

(54) EASY GOLF TEE

(71) Applicants: Abraham C. Lee, Plano, TX (US); John D. Lee, Plano, TX (US)

(72) Inventors: Abraham C. Lee, Plano, TX (US); John D. Lee, Plano, TX (US)

( * ) Notice: Subject to any disclaimer, the term of this patent is extended or adjusted under 35 U.S.C. 154(b) by 0 days.

(21) Appl. No.: 14/562,755

(22) Filed: Dec. 7, 2014

(51) Int. Cl.
*A63B 57/00* (2015.01)

(52) U.S. Cl.
CPC ..... *A63B 57/0018* (2013.01)

(58) Field of Classification Search
CPC ..... A63B 57/00; A63B 57/0018; A63B 57/0031; A63B 57/0043; A63B 57/005
See application file for complete search history.

(56) References Cited

U.S. PATENT DOCUMENTS

| | | | | | |
|---|---|---|---|---|---|
| 2,146,736 | A * | 2/1939 | Hammond | A63B 57/0018 | 473/397 |
| 2,712,939 | A * | 7/1955 | Harp | A63B 57/0018 | 473/265 |
| 2,839,304 | A * | 6/1958 | Lerick | A63B 57/0018 | 473/396 |
| 3,018,109 | A * | 1/1962 | Starck | A63B 69/3623 | 473/265 |
| 3,414,268 | A * | 12/1968 | Chase | A63B 57/0018 | 473/396 |
| 3,966,214 | A * | 6/1976 | Collins | A63B 57/0018 | 473/397 |
| 4,645,208 | A * | 2/1987 | Morabeto | A63B 57/0018 | 473/396 |
| 7,704,166 | B2 * | 4/2010 | Lim | A63B 57/0018 | 473/396 |
| 8,439,771 | B1 * | 5/2013 | Fleming | A63B 69/3623 | 473/257 |
| 8,460,127 | B2 * | 6/2013 | Kumar | A63B 57/0018 | 473/387 |
| 8,936,521 | B2 * | 1/2015 | Lee | A63B 57/0018 | 473/396 |
| 2005/0261089 | A1 * | 11/2005 | Homby | A63B 57/0018 | 473/387 |
| 2006/0058120 | A1 * | 3/2006 | Anton | A63B 57/005 | 473/386 |
| 2013/0331206 | A1 * | 12/2013 | Kumar | A63B 57/0018 | 473/396 |

* cited by examiner

*Primary Examiner* — Steven Wong

(57) ABSTRACT

Disclosed is a golf tee foldable, through rotation, in a direction of a drive swing to prevent breakage and loss and increase the drive shot distance. The golf tee comprises a ball platform; a supporting pillar; a coupling ball; and a ball coupling portion having a fixation pin. The ball coupling portion has two quarter-spherical shells symmetrically facing each other, separated by a contoured crevice of a uniform width defined by two opposing top edges of the shells. The two shells define a generally hemispherical receptacle for holding the coupling ball therein, which is open partially through the crevice and through a horseshoe-shaped bottom opening formed by two bottom edges of the shells. The crevice is sized and configured such that at a drive swing, the supporting pillar, being restricted by the two shells, moves only along the crevice, and thereby rotates and folds only in a single plane.

15 Claims, 4 Drawing Sheets

EASY GOLF TEE

FIELD OF INVENTION

This invention relates to a golf tee, and more particularly, to a foldable golf tee for facilitating a drive swing and preventing physical breakage and loss of the tee.

BACKGROUND

A tee shot is the first strike of every hole in golf, for which a golf tee supporting a golf ball at a certain height from the tee ground is used. Typically, a golf tee includes a fixation portion whose distal end is inserted into the ground to fix the tee and a concave supporting portion integrally formed with the fixation portion, on which a golf ball is placed for a golfer to strike a drive shot in a desired direction. When the head of a gold club hits the tee body exposed above the ground, which happens all too often in a golf game, the golf tees, typically made of wood or plastics, are easily broken to become non-reusable. Even if the tees are not broken, they are easily dislodged out of the ground, flown far away, and lost. An inexperienced golfer may easily spend more than a boxful of golf tees in a single eighteen-hole game because of the breakages or loss of the tees, which could inflict a considerable economic loss.

Therefore, there is a need to provide a golf tee that is structured not to be easily broken or lost by a mishit drive swing.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION

Figure 1:
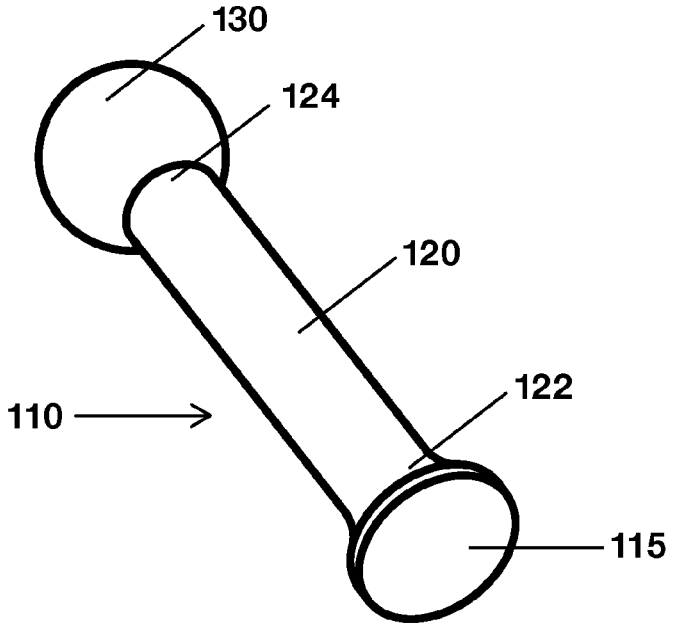
FIG. 1 is a perspective view of portions of a golf tee made according to an embodiment of the present disclosure.

It is understood that the following disclosure provides many different embodiments, or examples, for implementing different features of the invention. Specific examples of components and arrangements are described below just to simplify the present disclosure. These are, of course, merely examples and are not intended to be limiting. The present disclosure repeats reference numerals and/or letters for the equivalent, similar, or corresponding parts/elements in the examples illustrated in figures. This repetition, however, is for the sake of simplicity and clarity and does not in itself dictate a relationship between the various embodiments and/or configurations discussed. Moreover, various features in the figures are not drawn to the scale and may be arbitrarily drawn in different scales in different figures for the sake of simplicity and clarity.

The present disclosure provides a golf tee that is designed to be foldable in a direction of a drive swing to prevent breakages and loss of the tee from the strike and increase the drive shot distance by the reduced resistance of the tee at the moment of the strike.

Now referring to the figures, FIGS. 1-4 describe a golf tee 100 in accordance with embodiments of the present disclosure. The golf tee 100 comprises an upper tee portion 110, a coupling ball 130 and a lower tee portion 140. FIG. 1 describes the upper tee portion 110 and the coupling ball 130 in accordance with an embodiment of the present disclosure. The upper tee portion 110 has a ball platform 115 sized and configured to place a golf ball thereon and a supporting pillar 120. The ball platform 115 has, typically, the shape of a disc, which is slightly dented at the center of its top surface to secure a golf ball. But depending on embodiments, the ball platform 115 may have different shapes. For example, the platform 115 may have a forked edge rims (not shown) for a securer retainment of the ball. The supporting pillar 120 is an elongated body extending substantially perpendicularly, at its proximal end 122, from the bottom of ball platform 115 to the coupling ball 130 at its opposing distal end 124. In an embodiment, the supporting pillar 120 has generally a shape of a cylindrical bar as shown in FIG. 1, which has a circular cross section. But in other embodiments it may have other cross-sectional shapes, instead of a circle, such as a square, a triangle, or other polygons.

In an embodiment, the supporting pillar 120 and the ball platform 115 are integrally formed, but in another embodiment, may be separately formed and attached together by a suitable connecting means. Typically, the supporting pillar 120 and the ball platform 115 are fabricated of wood, plastics, or other synthetic resins or materials. But they could be made of metals or any other suitable materials known in the art as being capable of withstanding the impact from the head of a golf club at the time of a drive swing.

In an embodiment, various means of adjusting the weight of the supporting pillar may be employed. For example, one or a plurality of beads (not shown) made of plastics or other suitable material may be worn on the pillar and the weight of the pillar may be suitably adjusted as needed by changing the size, manufacturing material, or number of such beads. The beads may serve also ornamental purposes.

The coupling ball 130, shaped as a substantially spherical ball, is fixed to the distal end 124 of the supporting pillar 120 so that the two may move or rotate together. In an embodiment, the coupling ball 130 may be integrally formed with the supporting pillar 120 from the same material, but in anther embodiment, may be detachably fastened to the supporting pillar 120 via various fixation means. One of such means may be a connecting pin (not shown), of which one end may be fixed into a hole defined into the coupling ball 130 and the other end may be threadedly fastened to the distal end 124 of the supporting pillar 120 via an male and female threads formed, respectively, on the outer surface of the pin and on an inner surface of a hole defined at the distal end 124 of the supporting pillar 120. The size of the coupling ball 130 is suitably determined in consideration of the overall size of the tee 100. In an embodiment, the diameter of the coupling ball 130 may be slightly bigger than the diameter of the ball platform disc 115 for structural stability.

Figure 2A:
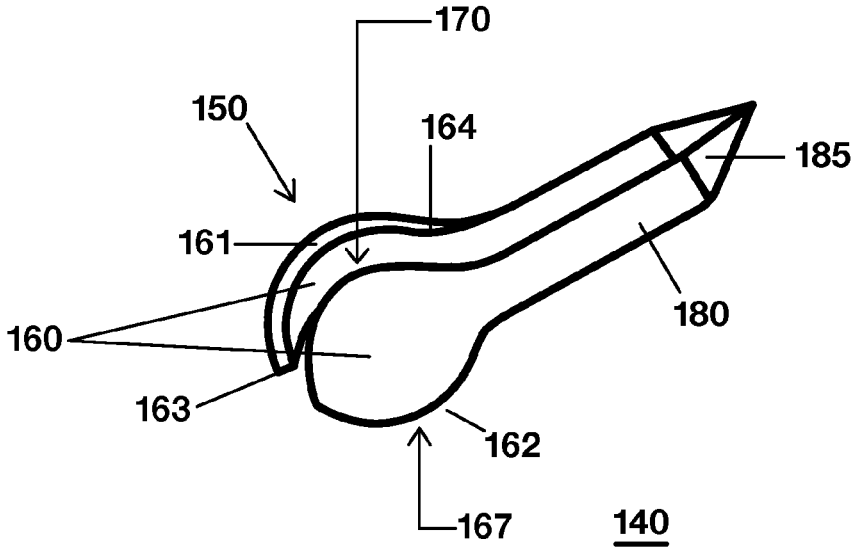
FIG. 2A is a perspective view of portions of a golf tee made according to an embodiment of the present disclosure.
Figure 2B:
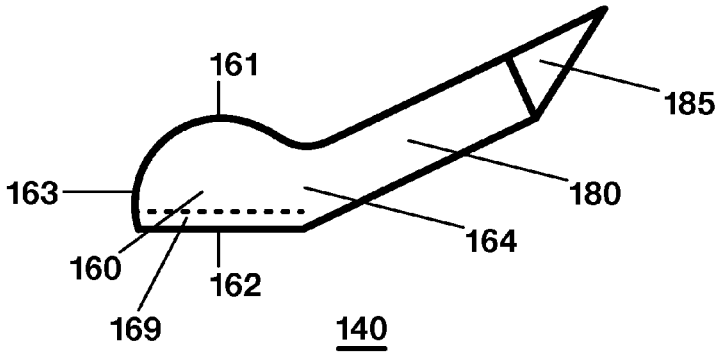
FIG. 2B is a side plan view of portions of a golf tee made according to an embodiment of the present disclosure.
Figure 2C:
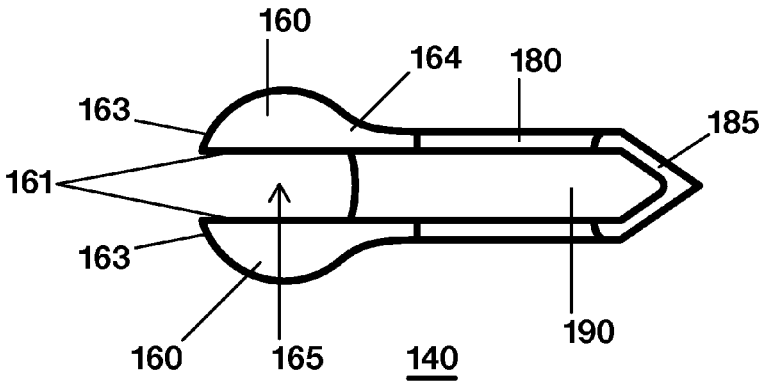
FIG. 2C is a top plan view of portions of a golf tee made according to an embodiment of the present disclosure.

FIGS. 2A-2C are a perspective view, a side plan view, and a top plan view, respectively, of the lower tee portion 140 of the golf tee 100 made in accordance with an embodiment of the present disclosure. The lower tee portion 140 comprises a ball coupling portion 150 and a fixation pin 180. The ball coupling portion 150 is sized and configured to hold the coupling ball 130 therein such that the ball 130, while being frictionally engaged with the ball coupling portion 150, is rotatable together with the upper portion 110 at an impact from a drive swing. Then the upper portion 110, affixed to the ball coupling portion 150, rotates together and is folded down in the direction of the drive swing.

Sill referring to FIGS. 2A-2C, the ball coupling portion 150 has two substantially identical shells 160, each having a substantially uniform thickness defined by a convex outer surface and a concave inner surface. In one embodiment, each of the shells 160 has generally the shape of a half hemisphere or a quarter of a spherical shell. Accordingly, each shell 160 has a generally semicircular contoured top edge 161 and a generally semicircular contoured bottom edge 162, which are adjoined each other at a proximal end 163 and a distal end 164. A generally quarter-spherical concave inner surface and a convex outer surface are defined between the top edge 161 and bottom edge 162. The two generally quarter-spherical shells 160 are symmetrically facing each other, spaced apart, such that the two generally semicircular contoured top edges 161 of the respective shells 160 are facing each other, while separated by an equal distance, as shown in FIG. 2A. This separation of an equal width between the two opposing top edges 161 of the shells 160 creates a contoured top crevice 165 of an equal width between the two shells 160. The top crevice 165 runs from the proximal ends 163 of the shells 160 to the distal end 164 thereof. FIG. 2C is the top plan view of the lower portion 140. From this viewing angle, the top crevice 165 looks as if it were a rectangular elongate strait, but in fact, since the two top edges 161 of the two shells 160 are generally semi-circularly contoured, as obviously seen from the side view of the lower portion 140 in FIG. 2B, the top crevice 165 itself, formed between the two top edges 161 of the two shells 160, is likewise contoured. The two generally semicircular contoured bottom edges 162 of the two shells 160 form a generally horseshoe-like bottom 167 of the ball coupling portion 150, which is opened at a side by the two spaced-apart proximal ends 163 of the two shells 160 where the top crevice 165 ends.

The two spaced apart, generally quarter-spherical shells 160 form, as combined, a generally hemisphere-shaped hollow receptacle 170 to receive the coupling ball 130 therein. The generally hemispherical receptacle 170, defined by the two generally quarter-spherical inner surfaces of the shells 160, is open through the contoured top crevice 165, and through the generally horseshoe-like bottom 167 demarked by two curved bottom edges 162 of the two shells 160. The coupling ball 130 may be manually engaged into or disengaged from the generally hemispherical receptacle 170 through the generally horseshoe-like bottom opening 167 of the receptacle 170. For example, the coupling ball 130 may be manually inserted into the receptacle 170 by pushing the ball 130 with a suitable amount of force through the generally horseshoe-like bottom 167. The ball 130 can be similarly disengaged out of the receptacle 170 by manually pulling it out through the generally horseshoe-like bottom 167 with a suitable amount of force.

The hemispherical receptacle 170 is suitably sized such that the coupling ball 130 is frictionally engaged in or fitted in, but rotatable at an impact of a drive shot while still being secured within the receptacle 170. The suitable size of the hemispherical receptacle 170 is determined by the size of the coupling ball 130 to be fitted therein. In an embodiment, the stationary size of the hemispherical receptacle 170 may be made slightly smaller than that of the coupling ball 130 to ensure a tighter retention of the latter. In that case, the coupling ball 130 can still be pushed into the slightly smaller hemispherical receptacle 170 by stretching the generally horseshoe-like bottom 167 and thereby slightly expanding the receptacle 170. The contoured top crevice 165 running through the ball coupling portion 150 helps such stretching. Once the suitable size of the hemispherical receptacle 170 is determined, the size of the two shells 160 and the contoured top crevice 165 are accordingly determined. The size of the substantially straight crevice 165 is determined in consideration of the overall size of the hemispherical receptacle 170 and the two shells 160. The width of the contoured top crevice 165 is substantially equal to that of the supporting pillar 120 so that at the impact of a drive shot on a tee, the supporting pillar 120 may rotate straight through the contoured top crevice 165.

The dimensions of various parts in the present invention described herein may be varied according different needs and embodiments. For example, in one embodiment, the length and width of the supporting pillar 120 may be given as 1.5 inch and 0.2 inch, respectively, the diameter and the thickness of the ball platform 115 0.45 inch and 0.11 inch, respectively, the diameter of the coupling ball 130 0.51 inch, the radius of the convex outer surface of each shell 160 0.325 inch, the radius of the concave inner surface of each shell 160 0.2 inch, rendering the thickness of each shell 160 to be 0.125 inch, and the width of the straight crevice 165 0.2 inch, identical to the width of the supporting pillar 120.

The two distal ends 164 of the two shells 160 may join each other. For instance, in an embodiment, as shown depicted in FIG. 2C, the two shells 160 are smoothly joined in a contoured strip at their distal ends 164. Such a contour strip may further extend towards the respective proximal ends 163 of the shells 160 to form a round band having a slightly inwardly bent bottom as shown in FIG. 2B. Such a band 169, forming the lower portion of the ball coupling portion 150, is contiguous to the quarter-spherical bodies of the shells 160 above and may be integrally formed therewith out of the same material. The round band 169 is disjoined at the proximal ends 163 of the shells 160 by the contoured top crevice 165. In this embodiment, the bottom edge of the round band 169 forms the bottom edges 162 of the two shells 160 as shown in FIG. 2B, and defines the generally horseshoe-like bottom opening 167 of the hemispherical receptacle 170. The slightly downward-inwardly bent band 169 provides not only an increased side area for holding the coupling ball 130, but also a slightly reduced size of the generally horseshoe-like bottom opening 167, and thereby enables a securer retention of the coupling ball 130 within the receptacle 170 against an impact on the tee 100 from a drive swing.

Referring back to FIGS. 2A-2C, the fixation pin 180 extends from the ball coupling portion 150, and more specifically, from the distal ends 164 of the two shells 160. In an embodiment described herein and in FIGS. 2A-2C, the distal ends 164 of the two shells 160 are joined at a portion of the round band 169 and the fixation pin 180 extends outward from that joint. The pin 180 has, in one embodiment, a generally cylindrically shaped body of a generally circular cross section and a sharp, wedge-shaped distal end 185 to be inserted into the ground. But in other embodiments, the pin 180 may have other geometrical cross-sectional shapes, such as a triangle or a square, as long as it is configured to penetrate the ground and provide a sufficient support and fixation to the golf tee 100.

Now referring to FIGS. 2A-2B, the fixation pin 180 may extend, from adjacent the distal ends 164 of the two shells 160, upward at an angle with respect to the plane of the generally horseshoe-like bottom opening 167 that is defined by two curved bottom edges 162 of the two shells 160. The angle of between the elongate body of the fixation pin 180 and the plane of the bottom opening 167 may vary in the range between about 20-50 degrees. In an embodiment, described in FIGS. 2A-2C, the entire body of the fixation pin 180 may be integrally formed with the two shells 160 at their distal ends 164 together with the round band 169. In another embodiment, the proximal end, or the root portion, of the pin 180 may be adjoined to the two distal ends 164 of the shells 160 by any suitable attachment or fastening means known in the art such as welding, frictional fitting, or a threaded connection.

Now referring to FIG. 2C, in an embodiment of the present disclosure, the fixation pin 180 may have an elongate burrow 190 defined on an upper side along its longitudinal axis. The elongate burrow 190 is aligned with the contoured top crevice 165 defined between the two top edges 161 of the shells 160 so that the supporting pillar 120 may fit into the burrow 190 after being completely folded through the crevice 165. Accordingly, the elongate burrow 190 has a width substantially equal or slightly less than that of the supporting pillar 120 and a suitable depth to frictionally fit the latter therein, and a suitable length to accommodate a substantial length of the supporting pillar 120 therein.

Figure 3A:
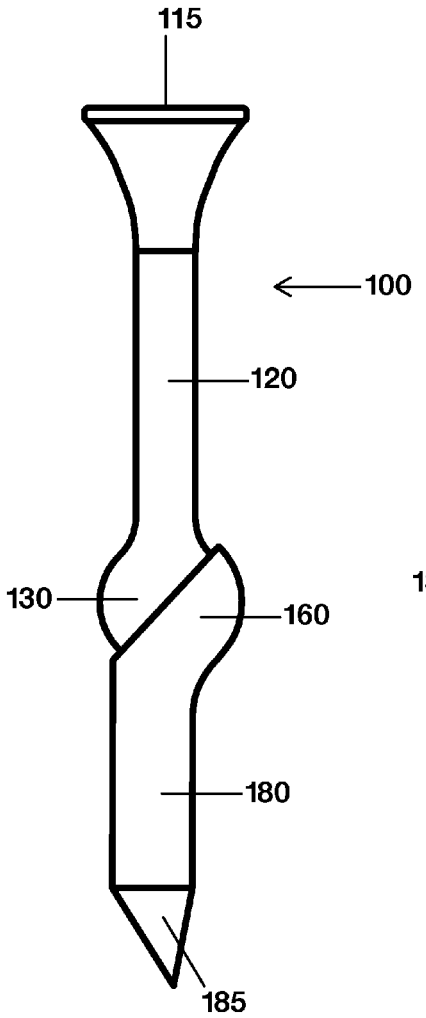
FIG. 3A is a side plan view of a golf tee made according to an embodiment of the present disclosure, in an upright stand-by position.

FIG. 3A is a side plan view of the golf tee 100 made in an embodiment of the present disclosure. Here, the upper tee portion 110 comprising the ball platform 115, the supporting pillar 120 and the ball 130 are coupled, in an upright position, to the lower tee portion 140 comprising the two shells 160 and the fixation pin 180. This is the position of the tee before a golfer hits a ball.

The golf tee made according to embodiments of the present invention permits the rotation of the upper portion 110 of the tee 100 in two opposite directions. In other words, it allows two different kinds of a drive swing as deemed adequate depending on the skill and experience of a golfer and the particular circumstance of a drive swing.

Figure 3B:
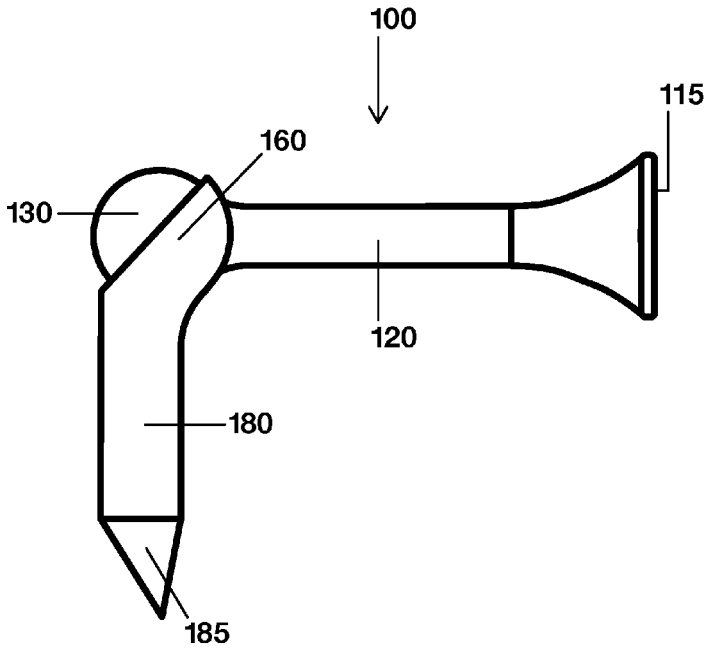
FIG. 3B is a side plan view of a golf tee made according to an embodiment of the present disclosure, in a post-strike position.

FIG. 3B is a side plan view of the golf tee 100 made in an embodiment of the present disclosure where the supporting pillar 120 and the coupling ball 130 have been rotated together within the receptacle 170 and folded in 90 degrees in the direction of a drive swing. In this way of rotation, the supporting pillar 120 rotates through and out of the contoured top crevice 165 shown in FIG. 2C while a portion of the coupling ball 130 bulges out of the generally horseshoe-like bottom opening 167 as seen in FIG. 3B. Since the supporting pillar 120 is restricted by the two shells 160 to move only along the top crevice 165 as obviously seen in FIG. 2C, its rotation is confined in a single plane in the direction of a drive swing, in this case the plane of FIG. 3B. This type of the drive swing may be more suitable for beginners in golf. After the drive swing, the supporting pillar 120 can be rotated back and return to the stand-by position as in FIG. 3A, and thus, the golf tee 100 in the present disclosure is prevented from breakages and losses commonly occurring to the conventional tees.

Figure 3C:
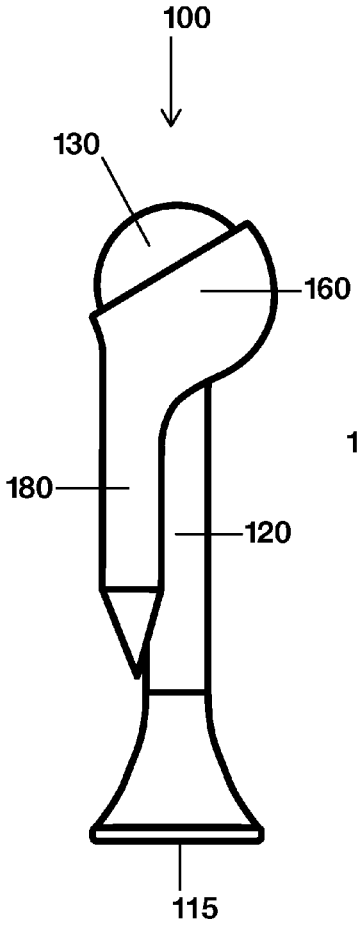
FIG. 3C is a side plan view of a golf tee made in accordance with an embodiment of the present disclosure, in a fully folded position.

FIG. 3C is another side plan view of the golf tee 100 made in an embodiment of the present disclosure where the supporting pillar 120 and the coupling ball 130 have been further rotated together within the receptacle 170 and folded completely in 180 degrees, thereby greatly reducing the size of the tee, almost to its half. The supporting pillar 120 is neatly and tightly fitted in the elongate burrow 190 defined on the fixation pin 180. This way of folding may not happen naturally during a drive swing. But a golfer can manually fold the tee like this and conveniently carry it in her or his pockets.

Figure 4:
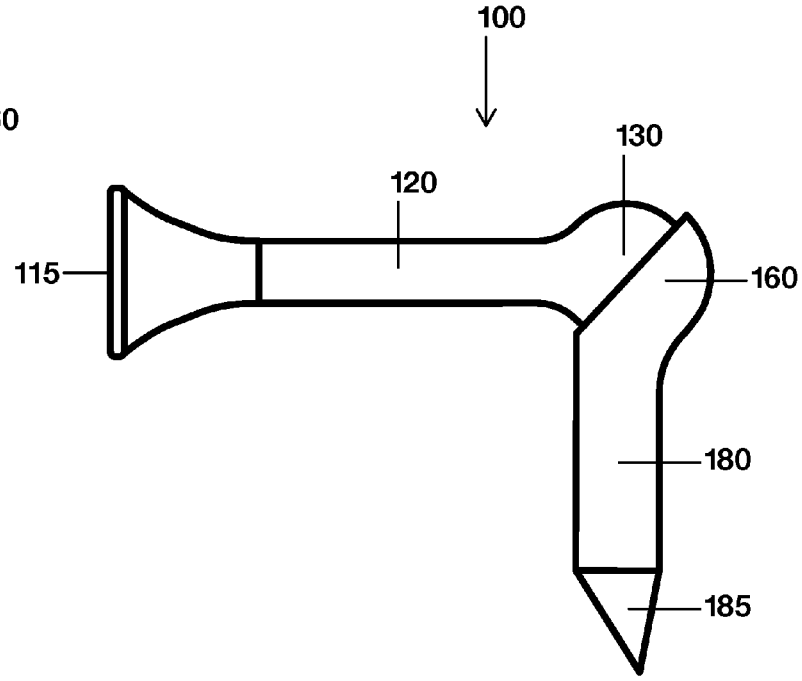
FIG. 4 is a side plan view of a golf tee made according to an embodiment of the present disclosure, in another post-strike position.

FIG. 4 is a side plan view of the golf tee 100 made in an embodiment of the present disclosure where the coupling ball 130 within the receptacle 170 have rotated by 90 degrees towards the generally horseshoe-like bottom opening 167, an opposite direction as compared to FIG. 3B. The supporting pillar 120 becomes similarly folded in the direction of a driving shot. But in this mode of rotation, there is no structure, like the two shells 160 in FIG. 2C, to restrict the motion of the supporting pillar 120 and confine its rotation in a single plane. Therefore, when a drive swing is applied to the tee in this direction, the supporting pillar 120 may not necessarily rotate in a plane of FIG. 4, but may wobble, together with the coupling ball 130, due to the increased freedom of motion allowed to the supporting pillar 120. Another difference from the rotation of the supporting pillar 120 in FIG. 3B is that in the way of rotation in FIG. 4, the supporting pillar 120 is prevented from further rotation from the about 90 degree folded position. This is because the root portion of the supporting pillar 120 is blocked from further rotation by the bottom edges 162 of the shells 160 that define the generally horseshoe-like bottom opening 167. A drive swing in the direction as described in FIG. 4 may be preferred by more skilled and experienced golfers.

The various parts of the golf tee in the present invention including the supporting pillar, the coupling ball, the ball coupling portion, and/or the fixation pin are fabricated, typically, of wood, plastics, or other synthetic resins or materials. But they could be made of metals or any other materials known in the art to be suitable for withstanding the impact from a drive shot.

The golf tee fabricated according to the present disclosure has many advantages over the conventional tees. The feature of the golf tee, particularly the supporting pillar, being folded through rotation at a drive shot in the direction of a drive swing, enables a more effective swing at less exertion from the golfer and increases the drive shot distance by the reduced resistance of the tee at the moment of the strike. Further, since the folded tee can be returned to the upright stand-by position for reuse after the strike, the breakage and loss for the conventional tees, which caused not only economic loss but also environmental contaminations from the tee debris, are prevented.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A rotatable golf tee, comprising:

a dented ball platform sized and configured to place a golf ball thereon;

a supporting pillar extending, at a proximal end thereof, from the ball platform;

a spherical coupling ball joining the supporting pillar at a distal end thereof;

two substantially identical shells of a generally quarter-spherical configuration, each of the shells having a generally semicircular contoured top edge and a generally semicircular contoured bottom edge, the top edge and the bottom edge meeting each other at a distal end and at a proximal end of the each shell, the two shells symmetrically facing each other such that the top edges of the respective shells are spaced apart to define a contoured top crevice therebetween, the crevice being sized to pass the supporting pillar therethrough, the two shells and the top crevice collectively defining therein a generally hemispherical receptacle that is open through the top crevice and through an open bottom formed by the bottom edges of the shells; and a fixation pin extending from the distal ends of the shells.

2. The golf tee of claim 1, wherein the supporting pillar is integrally formed with the coupling ball.

3. The golf tee of claim 1, wherein the fixation pin is integrally formed with the shells.

4. The golf tee of claim 1, wherein the shells are sized to removably retain the coupling ball in the generally hemispherical receptacle.

5. The golf tee of claim 4, wherein the shells are further sized to allow frictional but rotatable retention of the coupling ball in the generally hemispherical receptacle.

6. The golf tee of claim 4, wherein the shells are further sized such that when the coupling ball is engaged in the receptacle, at least three fourths of the coupling ball is retained in the receptacle.

7. The golf tee of claim 1, wherein the contoured top crevice extends between the distal ends and the proximal ends of the respective shells.

8. The golf tee of claim 1, wherein the contoured top crevice has a substantially uniform width.

9. The golf tee of claim 8, wherein the width of the contoured top crevice is substantially equal to the width of the supporting pillar.

10. The golf tee of claim 1, wherein the two shells are joined at the respective distal ends thereof.

11. The golf tee of claim 10, wherein each of the respective bottom edges of the shells are joined at the respective distal ends such that the open bottom is generally horseshoe-shaped.

12. The golf tee of claim 1, wherein the fixation pin extends at an angle ranging between 20 and 50 degrees with respect to a plane of the bottom edges of the shells.

13. The golf tee of claim 1, wherein the fixation pin defines an elongate burrow thereon along a longitudinal body axis thereof, the burrow being sized and configured to receive the supporting pillar therein when the supporting pillar is folded.

14. The golf tee of claim 13, wherein the elongate burrow is aligned with the contoured top crevice.

15. The golf tee of claim 13, wherein the elongate burrow has a width substantially identical to that of the contoured top crevice.

* * * * *